US011297905B2

(12) United States Patent
Teramoto et al.

(10) Patent No.: US 11,297,905 B2
(45) Date of Patent: Apr. 12, 2022

(54) FASTENING PIN

(71) Applicant: Clover Mfg. Co., Ltd., Osaka (JP)

(72) Inventors: Yui Teramoto, Osaka (JP); Chihiro Iwasaki, Osaka (JP)

(73) Assignee: CLOVER MFG. CO., LTD., Osaka (JP)

( * ) Notice: Subject to any disclaimer, the term of this patent is extended or adjusted under 35 U.S.C. 154(b) by 0 days.

(21) Appl. No.: 17/203,596

(22) Filed: Mar. 16, 2021

(65) Prior Publication Data

US 2021/0298429 A1 Sep. 30, 2021

(30) Foreign Application Priority Data

Mar. 27, 2020 (JP) ..... JP2020-057854

(51) Int. Cl.
*A44B 9/12* (2006.01)

(52) U.S. Cl.
CPC ..... *A44B 9/12* (2013.01)

(58) Field of Classification Search
CPC .. A44B 9/12; A44B 9/125; A44B 9/14; Y10T 24/4695
See application file for complete search history.

(56) References Cited

U.S. PATENT DOCUMENTS 820,382 A * 5/1906 Carroll ..... A44B 9/14 24/709.9
3,136,014 A * 6/1964 Nickerson ..... A44B 9/14 24/709.9
3,268,966 A * 8/1966 Nickerson ..... A44B 9/14 24/709.9
3,293,712 A * 12/1966 Mark ..... A44B 9/14 24/710.1
4,071,927 A * 2/1978 Bagnasco ..... A44B 9/125 24/708.7
2006/0059668 A1* 3/2006 Kessler ..... A44B 9/12 24/710

FOREIGN PATENT DOCUMENTS

JP 7-298908 A 11/1995

* cited by examiner

*Primary Examiner* — Robert Sandy
(74) *Attorney, Agent, or Firm* — Hamre, Schumann, Mueller & Larson, P.C.

(57) ABSTRACT

A fastening pin includes a needle having a tip and a base end, a holder having a base-end holding part that holds the base end of the needle, and a hook part provided in the holder and configured for the tip of the needle to be hooked thereto. The needle has a non-straight shape bulging in a direction away from the holder and is elastically pivotable around the based end toward the hook part. The hook part is provided with a groove and a protruding guide part. The groove is open toward the holder and configured for the tip of the needle to engage therein. The protruding guide part is arranged on the opposite side of the holder with respect to the groove.

11 Claims, 7 Drawing Sheets

FASTENING PIN

FIELD

The present disclosure relates to a fastening pin used for temporary fastening in handicrafts.

BACKGROUND

In the field of handicraft called patchwork quilt, for example, a top cloth, a cotton layer and a back cloth are laid one on top of another and sewed together in the thickness direction. In doing such a work, the top cloth, the cotton layer and the back cloth are temporarily fastened together with e.g. a safety pin so as not to move relative to each other. To make a large work, such temporary fastening may be performed at more than 100 points, for example.

To temporarily fasten a plurality of cloths laid one on top of another, it is necessary to pass a needle of a safety pin through the cloths from the front side to the back side and then from the back side to the front side while holding the safety pin with one hand, and then close the needle (i.e., hook the needle tip to the tip-hooking part of the safety pin) with the other hand. Such a temporarily fastening work is troublesome and can be a burden on fingers or hands when performed at more than 100 points in cloths with a large area. It is desirable that such temporary fastening is performed with cloths spread on a large work table and without raising the cloths above the table as much as possible. However, scooping cloths with a safety pin is difficult. Therefore, temporary fastening is sometimes performed with part of cloths picked up and raised above the table. In such a case, the top cloth and the back cloth may become misaligned, which hinders proper temporary fastening.

JP-A-7-298908 discloses a safety pin with a needle that is bent in the middle such that the needle tip points toward the tip-hooking part. According to such a conventional safety pin, with cloths placed on e.g. a table, the tip of the needle, passed from the front side to the back side, can be oriented diagonally upward, using the bent part as the fulcrum on the table. Therefore, the work of passing the needle from the back side to the front side can be performed relatively easily.

However, the conventional safety pin is difficult to pick with fingers. Moreover, because it is a safety pin, its needle tip is hooked deep into the tip-hooking part and will not easily come off. Thus, the safety pin disclosed in JP-7-298908 may not be most suitable for smoothly performing the work of temporary fastening described above and releasing the fastening after completion of the sewing.

SUMMARY

Under the circumstances described above, an object of the present disclosure is to provide a fastening pin that makes it possible to easily perform the work of temporarily fastening a plurality of cloths (or its equivalent) laid one on top of another or releasing such fastening with one hand.

To solve the problems described above, the present disclosure takes the following technical means.

A fastening pin provided according to a first aspect of the present disclosure includes: a needle having a tip and a base end; a holder having a base-end holding part that holds the base end of the needle; and a hook part provided in the holder and configured for the tip of the needle to be hooked thereto. The needle has a non-straight shape bulging in a direction away from the holder and is elastically pivotable around the based end toward the hook part. The hook part is provided with a groove and a protruding guide part. The groove is open toward the holder and configured for the tip of the needle to engage therein. The protruding guide part is arranged on the opposite side of the holder with respect to the groove.

Other features and advantages of the present disclosure will become apparent from the detailed description given below with reference to the accompanying drawings.

DRAWINGS

EMBODIMENTS

Preferred embodiments of the present disclosure are described below with reference to the accompanying drawings.

FIGS. 1-11 show a handicraft assist tool or fastening pin A1 according to a first embodiment.

As shown in FIGS. 1-4, a fastening pin A1 includes a needle 1 having a tip 11, a holder 2 holding a base end of the needle 1, and a hook part 3.

Figure 2:
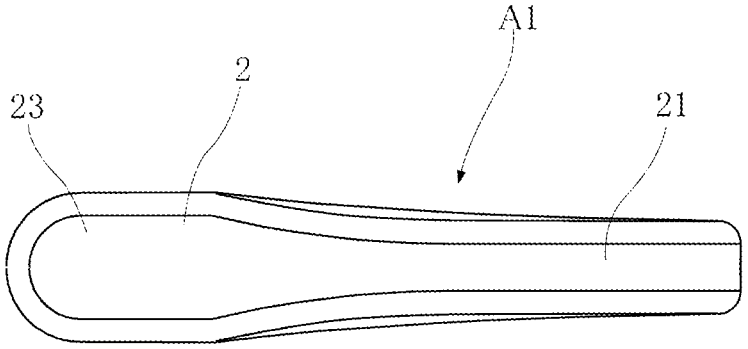
FIG. 2 is a plan view of the fastening pin.

The holder 2 is a resin-molded part and widens gradually as proceeding toward the front end (left end in FIG. 2), providing a widened part 23 on the upper side of the front end, as shown in FIG. 2. The hook part 3, which is the part for hooking the tip 11 of the needle 1, is provided on the lower side of the front end of the holder 2. In the example illustrated in the figures, the holder 2 and the hook part 3 are formed integrally with each other, but the present disclosure is not limited to such a configuration. For example, the holder 2 and the hook part 3 may be formed separately, and then the hook part 3 may be attached to a predetermined point of the holder 2. The holder 2 is formed with a pinch part 21 projecting on the upper side of the base end (right end in FIG. 2) for a user to pinch with fingers to hold the assist tool A1. The pinch part 21 is a plate-like part with a thickness that allows for easy pinching by the user.

Figure 1:
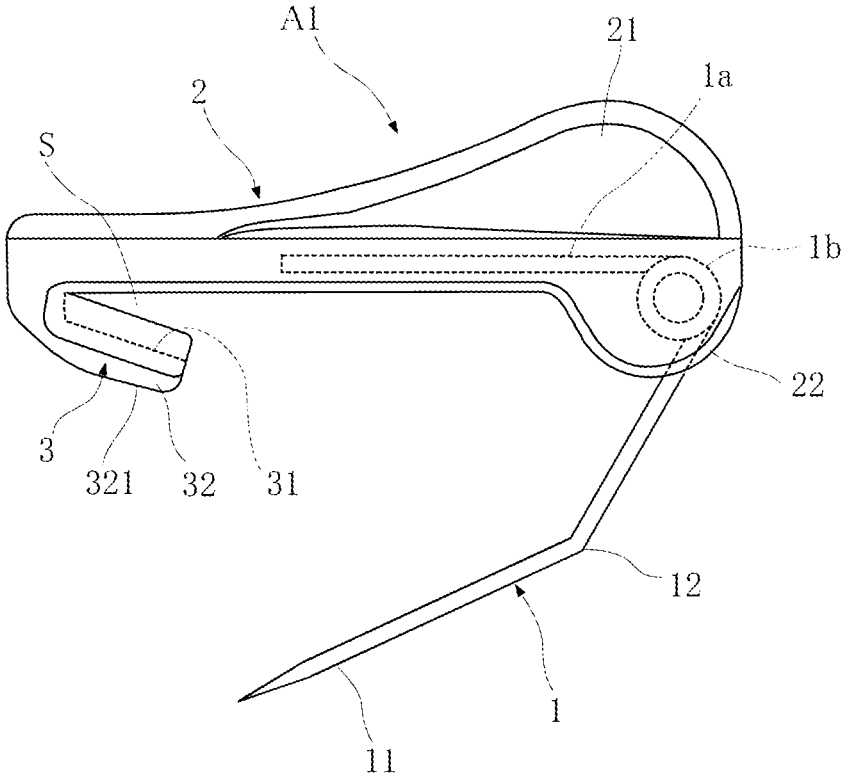
FIG. 1 is a front view of a fastening pin according to a first embodiment.

The needle 1 is made of a metal with spring-back characteristics and includes a base part 1*a* embedded in the holder 2, a coil part 1*b*, and a movable part extending from the coil part 1*b* to the outside, as shown in FIG. 1. The tip 11 of the movable part (or, of the needle 1) is sharp. The needle 1 (movable part) has a non-straight portion 12 that bulges in a direction away from the holder 2. In the illustrated example, the non-straight portion is a bent portion, and the bent portion is provided generally in the middle of the movable part (or externally extending part). In the natural state, the needle 1 (the movable part or externally extending part) extends in a direction away from the holder 2. By applying an external force to the needle 1 (the movable part or externally extending part), the movable part (needle 1) can be pivoted elastically around the coil part 1*b*. That is, the movable part (needle 1) can be pivoted against the elastic recovery force of the coil part 1*b* by using the coil part 1*b* as the fulcrum. By this operation, the tip 11 can be hooked onto the hook part 3 when necessary (see FIG. 4).

Figure 3:
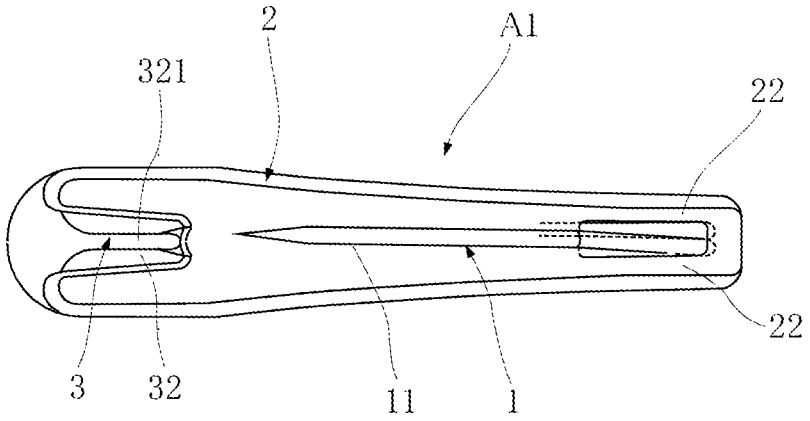
FIG. 3 is a bottom view of the fastening pin.

As shown in FIGS. 1 and 3, the holder 2 is formed with a pair of round parts 22 each having a gently curved convex edge correspondingly to the portion in which the base end of the needle 1 is held (the portion in which the coil part 1*b* is housed in the present embodiment). As will be understood from FIGS. 1 and 3, the paired round parts 22 are formed so as to flank the coil part 1*b* and part of the movable part of the needle 1. In the example shown in FIGS. 1 and 4, the outer edge of each round part 22 is arcuate (or substantially arcuate). Preferably, each round part 22 is configured such that the needle 1 (movable part) extends generally along the tangential direction of the outer edge, but the present disclosure is not limited to such a configuration.

The size of the fastening pin A1 is substantially defined by the size of the holder 2. The total length (the size in the horizontal direction in FIG. 1) of the holder 2 is about 30 to 40 mm. In that case, the diameter of the needle 1 is about 0.7 mm, for example.

Figure 4:
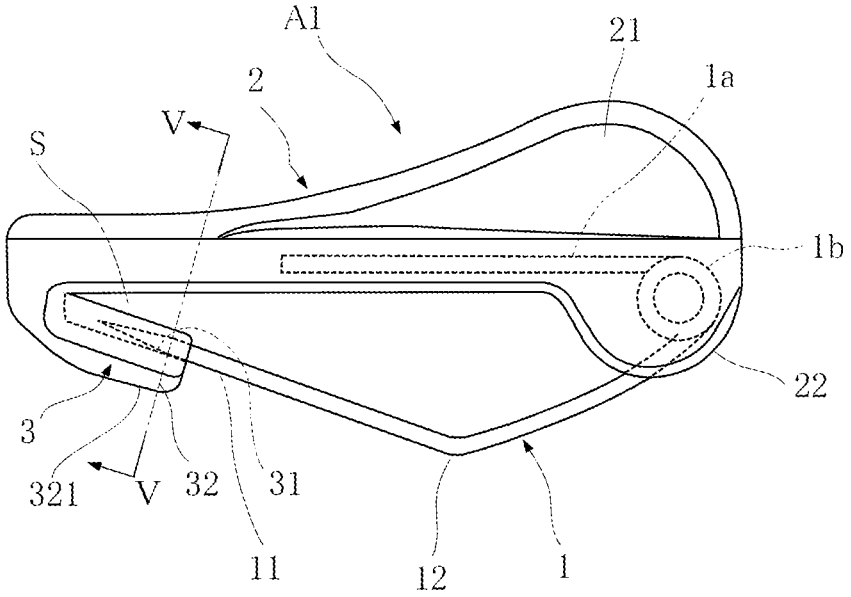
FIG. 4 is a front view of the fastening pin in the state in which the needle is hooked in a hook part.

As shown in FIG. 4, the tip 11 of the needle 1 is hooked onto the hook part 3. The hook part 3 extends from the lower side of the front end of the holder 2 diagonally downward so as to correspond to the direction in which the tip 11 of the needle 1 extends. The hook part 3 has a groove 31 (see FIG. 5) in which the tip 11 of the needle 1 engages and a protruding guide part 32 formed opposite the groove 31. More precisely, the protruding guide part 32 is provided on the opposite side of the holder 2 with respect to the groove 31.

A space S is provided between the hook part 3 and the holder 2, and the groove 31 is open toward the space S, and hence, toward the holder 2. The depth D of the groove 31 (see FIG. 6) is set such that the cross section of the tip 11 of the needle 1 is entirely received in the groove 31. Specifically, the depth D is set to not less than 1.0 times and not more than 2.5 times, 2.0 times or 1.5 times the diameter d of the tip 11. When the diameter d of the tip 11 is 0.7 mm, the depth D of the groove 31 may be set to not less than about 1.1 mm and not more than 1.5 mm, for example. Note that the diameter d of the tip 11 refers to, for example, the maximum one of the cross-sectional diameters of the part of the needle 1 that is received in the groove 31 (groove engaging part). In the example shown in FIG. 4, the groove engaging part of the needle 1 is made up of a tapered conical portion and a columnar portion continuous with (formed integrally with) the conical portion. The columnar portion has a constant cross-sectional diameter, which is the largest one among the cross-sectional diameters of the groove engaging part. Thus, in the example of FIG. 4, the cross-sectional diameter of the columnar portion corresponds to the above-described "diameter d".

Figure 5:
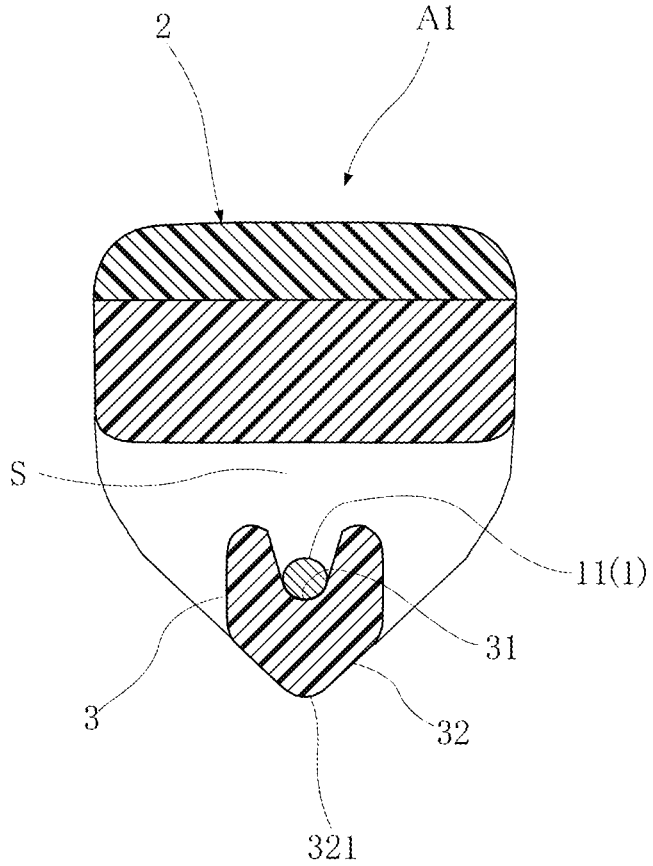
FIG. 5 is a sectional view taken along line V-V in FIG. 4.
Figure 6:
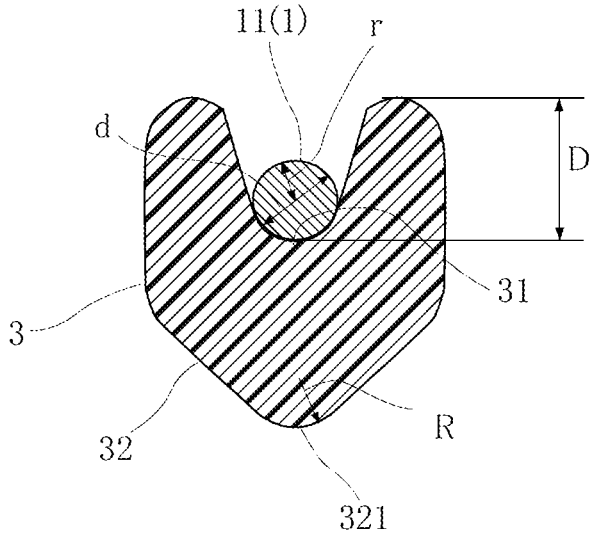
FIG. 6 is an enlarged view of a part of FIG. 5.

As shown in FIGS. 5 and 6, the protruding guide part 32 has a generally triangular cross section with an apex 321. That is, as viewed in the longitudinal direction in which the groove 31 is elongated (or as viewed in the longitudinal direction of the tip 11 of the needle received in the groove 31), the protruding guide part 32 generally has the shape of a triangle with the apex 321. It is preferable that the apex 321 is moderately sharpened in a direction away from the holder 2 as shown in FIG. 5, but microscopically, its outer edge may be a gentle curve (see FIG. 6). In the present embodiment, the apex 321 has a radius of curvature R. The radius of curvature R may be about 0.5 mm, for example, which is about 1.43 times the radius r of the tip 11 of the needle 1. More generally, the radius of curvature R of the apex 321 of the protruding guide part 32 is set to not more than 2.0 times or not more than 1.5 times the radius r of the tip 11 of the needle 1.

The usage and advantages of the fastening pin A1 is described below in relation to the temporary fastening in patchwork quilting.

Figure 7:
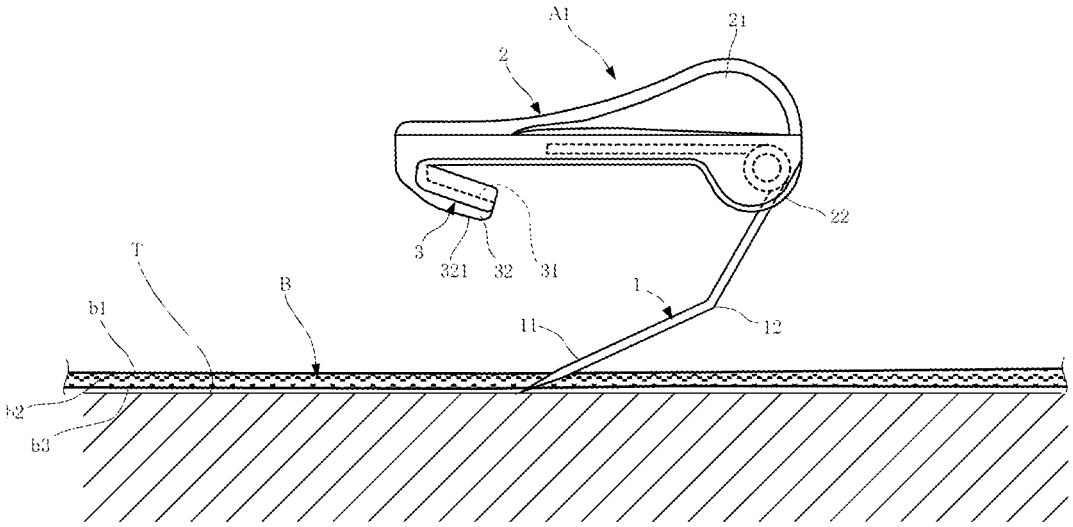
FIG. 7 is a view for illustrating the operation of the fastening pin.

As shown in FIG. 7, a material cloth B, made up of a top cloth b1, a cotton layer b2 and a back cloth b3 laid one on top of another, is placed on a work table T. In this state, the holder 2 is held by pinching the pinch part 21, and the needle 1 is passed through the material cloth B from the front side to the back side.

Figure 8:
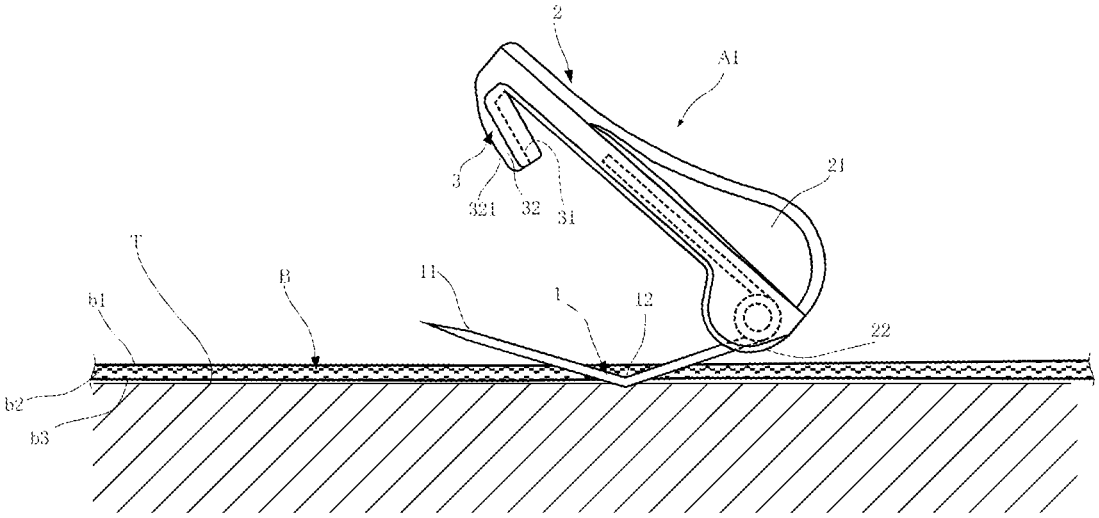
FIG. 8 is a view for illustrating the operation of the fastening pin.

As shown in FIG. 8, while the pinch part 21 is pushed down to point the tip 11 of the needle 1 diagonally upward by using the non-straight portion (bent part) 12 as the fulcrum, the needle 1 is passed through the material cloth B from the back side to the front side.

Figure 9:
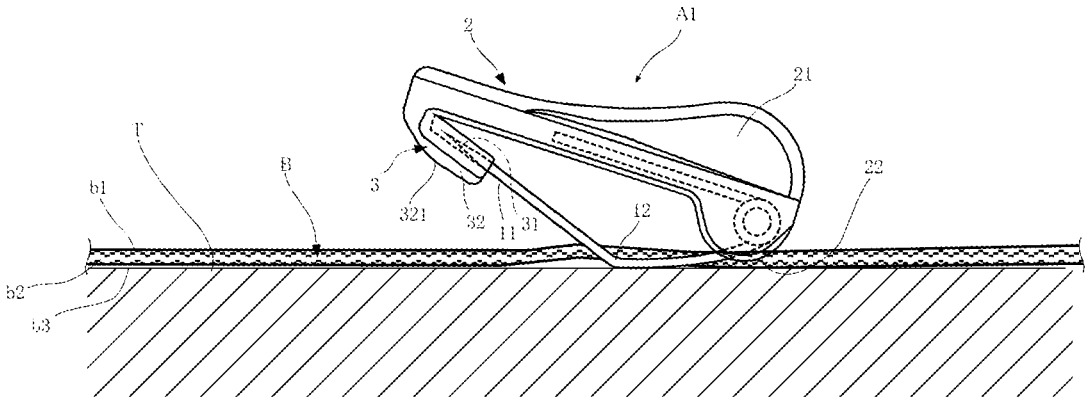
FIG. 9 is a view for illustrating the operation of the fastening pin.

As shown in FIG. 9, the holder 2 is pivoted around the round parts 22 by pushing down the front side, to thereby cause the tip 11 of the needle 1 to engage in the groove 31 of the hook part 3. As described before, the paired round parts 22 flanking the needle 1 have an entirely constant width and an outer edge that is arcuate in front view (see FIGS. 1 and 4, etc). Thus, the pivotal movement of the holder 2 described above can be performed stably and smoothly by using the arcuate outer edges as a guide.

Figure 11:
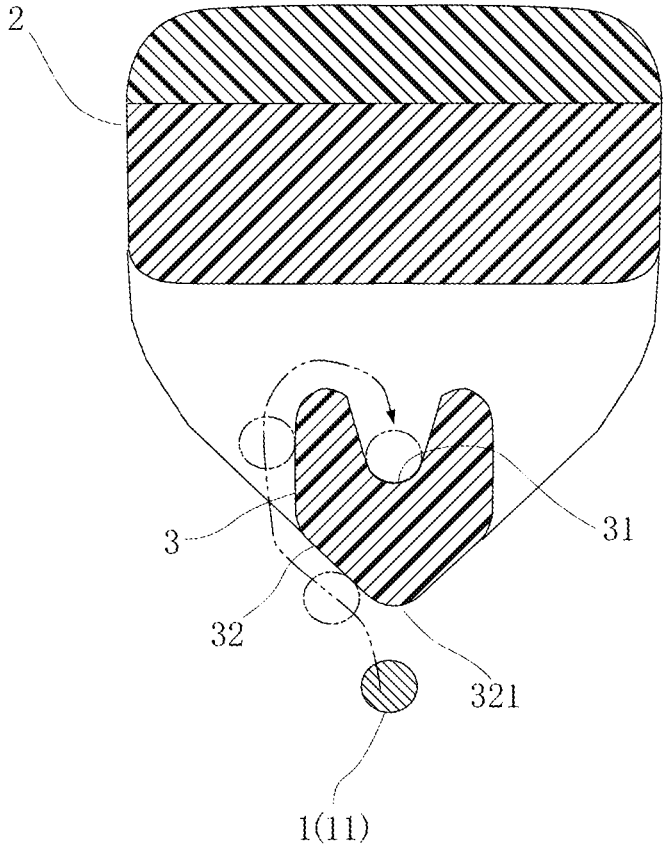
FIG. 11 is a view for illustrating the operation of the fastening pin.

How the tip 11 of the needle 1 engages in the groove 31 of the hook part 3 is described below with reference to FIG. 11. As described above, the protruding guide part 32 of the hook part 3 is formed with a sharpened apex 321. This allows the needle 1 to be smoothly guided onto a side surface of the protruding guide part 32 and then to readily engage in the groove 31. Moreover, according to the present embodiment, the holder 2, which has the pinch part 21 for a user to pinch, is additionally formed with the widened part 23 at the front end. The work of pushing down the front side of the holder 2 described above can be performed easily by pressing the widened part 23.

Figure 10:
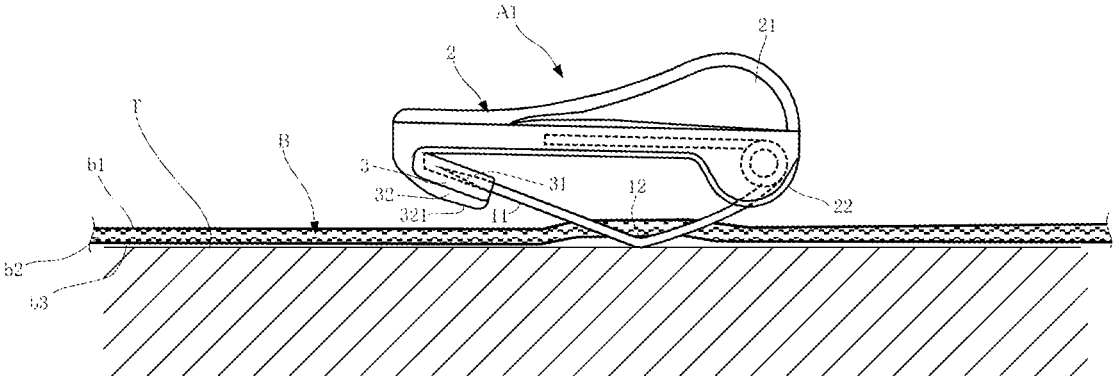
FIG. 10 is a view for illustrating the operation of the fastening pin.

FIG. 10 shows how the temporary fastening is released. To release the temporary fastening, the entirety of the holder 2 is pushed down and slid sideways from the needle 1, as shown in the figure. In this way, the needle 1 is easily disengaged from the groove 31. The holder 2 may be later pulled backward so that the needle 1 is pulled out of the material cloth B.

In this way, the fastening pin A1 makes it possible to smoothly and easily perform temporary fastening with one hand, with the material cloth B resting on the work table T. Thus, even when the material cloth B has a large area and temporary fastening needs to be performed at a plurality of points, the entire fastening work can be performed efficiently, and the burden on fingers or hands can be reduced.

The present disclosure is not limited to the embodiment described above, and various modifications can be made without departing from the technical ideas of the present disclosure.

Figure 12:
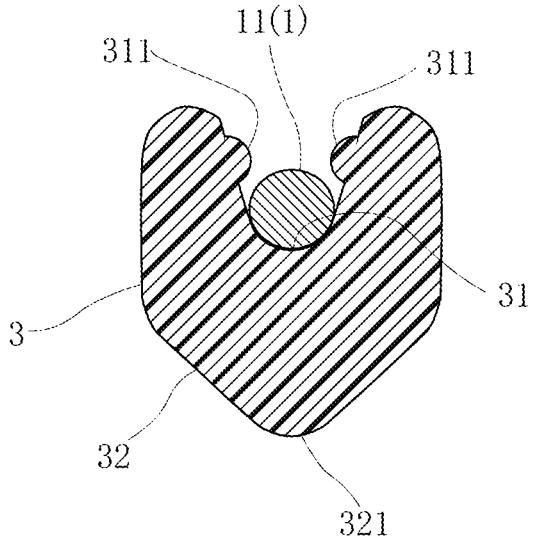
FIG. 12 is a sectional view of a fastening pin according to a second embodiment.

For example, it is desirable that the groove 31 of the hook part 3 has an appropriate depth that allows for easy engagement and disengagement of the needle 1. (For example, it may be desirable to make the depth as small as possible.) On the other hand, in the temporarily fastened state, the needle 1 needs to be held so as not to come off the groove 31. As a means to achieve this, it may be considered to provide an engagement projection 311 on each of opposite inner walls of the groove 31, as shown in FIG. 12. Each engagement projection 311 may be arranged close to the opening of the groove 31 or may be provided at a position away from the opening toward the lower side (toward the apex 321) by a predetermined distance. Each engagement projection 311 may be elongated along the longitudinal direction of the groove 31. (For example, the length of the groove 31 in the longitudinal direction and the length of each engagement projection 311 may be substantially equal to each other.) Alternatively, each engagement projection 311 may be provided only at a limited region of the groove 31 in the longitudinal direction.

Figure 13:
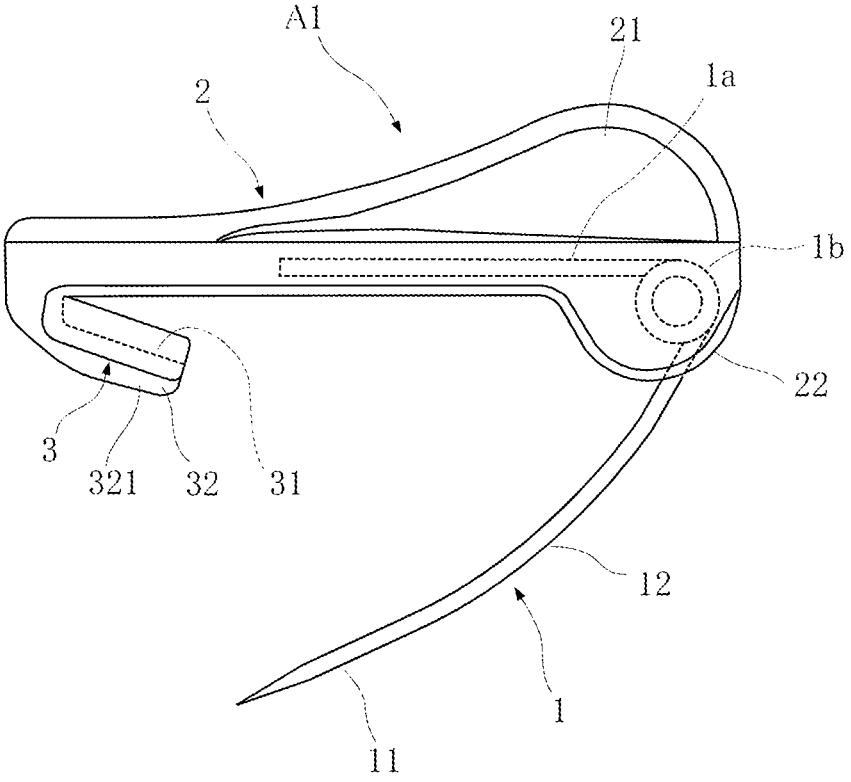
FIG. 13 is a front view of a fastening pin according to a third embodiment.

In the present embodiment, the non-straight portion 12 of the needle 1 is bent, but the present disclosure is not limited to this. For example, the non-straight portion 12 may have a gently curved convex shape, as shown in FIG. 13. In the present embodiment, the fastening pin A1 is used for temporary fastening performed in the field of handicraft, but the present disclosure is not limited to this. The fastening pin A1 can be widely used in various fields to fasten a plurality of cloths or sheets, for example, laid one on top of another.

The invention claimed is:

1. A fastening pin comprising:

a needle having a tip and a base end;

a holder having a base-end holding part that holds the base end of the needle: and a hook part provided in the holder and configured for the tip of the needle to be hooked thereto, wherein the needle has a non-straight shape bulging in a direction away from the holder and is elastically pivotable around the base end toward the hook part, the hook part is provided with a groove and a protruding guide part, the groove being open toward the holder and configured for the tip of the needle to engage therein, the protruding guide part being arranged on an opposite side of the holder with respect to the groove, and the groove has a depth that is not more than 2.5 times a diameter of a groove engaging part of the needle that engages in the groove.

2. A fastening pin comprising:

a needle having a tip and a base end;

a holder having a base-end holding part that holds the base end of the needle: and a hook part provided in the holder and configured for the tip of the needle to be hooked thereto, wherein the needle has a non-straight shape bulging in a direction away from the holder and is elastically pivotable around the base end toward the hook part, the hook part is provided with a groove and a protruding guide part, the groove being open toward the holder and configured for the tip of the needle to engage therein, the protruding guide part being arranged on an opposite side of the holder with respect to the groove, and the protruding guide part has an apex that is sharpened in a direction away from the holder as viewed in an axial direction of the needle.

3. The fastening pin according to claim 2, wherein the apex of the protruding guide part has a predetermined radius of curvature as viewed in the axial direction of the needle, and the radius of curvature is not more than 2.0 times a radius of the groove engaging part of the needle.

4. The fastening pin according to claim 2, wherein the holder is formed with a pinch part projecting to an opposite side to the needle.

5. The fastening pin according to claim 2, wherein the holder and the hook part are resin-molded, and the needle is made of a metal.

6. A fastening pin comprising:

a needle having a tip and a base end;

a holder having a base-end holding part that holds the base end of the needle: and a hook part provided in the holder and configured for the tip of the needle to be hooked thereto, wherein the needle has a non-straight shape bulging in a direction away from the holder and is elastically pivotable around the base end toward the hook part, the hook part is provided with a groove and a protruding guide part, the groove being open toward the holder and configured for the tip of the needle to engage therein, the protruding guide part being arranged on an opposite side of the holder with respect to the groove, and the base-end holding part of the holder is formed with a pair of round parts.

7. The fastening pin according to claim 6, wherein the paired round parts are arranged to flank a part of the needle extending out of the holder, and each of the round parts has an arcuate outer edge.

8. The fastening pin according to claim 6, wherein the holder is formed with a pinch part projecting to an opposite side to the needle.

9. The fastening pin according to claim 6, wherein the holder and the hook part are resin-molded, and the needle is made of a metal.

10. The fastening pin according to claim 1, wherein the holder is formed with a pinch part projecting to an opposite side to the needle.

11. The fastening pin according to claim 1, wherein the holder and the hook part are resin-molded, and the needle is made of a metal.

* * * * *